US011988210B2

(12) United States Patent
Xiong et al.

(10) Patent No.: US 11,988,210 B2
(45) Date of Patent: May 21, 2024

(54) DRY DUAL-SCROLL VACUUM PUMP

(71) Applicant: Zhejiang University, Zhejiang (CN)

(72) Inventors: Shusheng Xiong, Zhejiang (CN); Renpu Jiang, Zhejiang (CN); Guodong Chen, Zhejiang (CN)

(73) Assignee: Zhejiang University, Hangzhou (CN)

( * ) Notice: Subject to any disclaimer, the term of this patent is extended or adjusted under 35 U.S.C. 154(b) by 250 days.

(21) Appl. No.: 17/500,942

(22) Filed: Oct. 14, 2021

(65) Prior Publication Data

US 2022/0034321 A1 Feb. 3, 2022

Related U.S. Application Data

(63) Continuation of application No. PCT/CN2019/124711, filed on Dec. 12, 2019.

(30) Foreign Application Priority Data

Jun. 26, 2019 (CN) ..... 201910559359.5

(51) Int. Cl.

| | |
|---|---|
| ***F04C 18/02*** | (2006.01) |
| ***F04C 25/02*** | (2006.01) |
| ***F04C 27/00*** | (2006.01) |
| ***F04C 29/00*** | (2006.01) |
| ***F04C 29/04*** | (2006.01) |
| ***F04C 29/12*** | (2006.01) |

(52) U.S. Cl.

CPC ..... *F04C 25/02* (2013.01); *F04C 18/0215* (2013.01); *F04C 18/0223* (2013.01); *F04C 27/00* (2013.01); *F04C 29/04* (2013.01); *F04C 2240/60* (2013.01); *F04C 2240/807* (2013.01)

(58) Field of Classification Search

CPC ..... F04C 18/0215; F04C 18/0223; F04C 18/0253; F04C 18/0269; F04C 27/007; F04C 29/04; F04C 29/12; F04C 29/0021

See application file for complete search history.

(56) References Cited

U.S. PATENT DOCUMENTS 11,473,572 B2 * 10/2022 Wilson ..... F04C 29/04

FOREIGN PATENT DOCUMENTS

CN 1570389 A 1/2005
CN 101324235 A 12/2008

(Continued)

OTHER PUBLICATIONS

English translation of WO2017195272 by PE2E May 12, 2023.*

(Continued)

*Primary Examiner* — Deming Wan

(57) ABSTRACT

A dry dual-scroll vacuum pump includes a driving assembly and an upper cover located above the driving assembly, wherein the driving assembly includes an output shaft, and a movable disk is eccentrically arranged on the output shaft; two groups of first scroll teeth that are centrally symmetrical are arranged on a side of the movable disk that faces the upper cover; a fixed disk is arranged at a lower end of the upper cover, second scroll teeth that are in one-to-one correspondence with the first scroll teeth are arranged on the fixed disk, and the first scroll teeth are meshed with the second scroll teeth to form a compression cavity; and the upper cover is further provided with an air inlet and an air outlet, which correspond to the compression cavity.

9 Claims, 5 Drawing Sheets

(56) References Cited

FOREIGN PATENT DOCUMENTS

| | | | | | |
|---|---|---|---|---|---|
| CN | 201318287 | Y | * | 9/2009 | |
| CN | 101952550 | A | * | 1/2011 | ..... F01C 1/0215 |
| CN | 103306973 | A | | 9/2013 | |
| CN | 204003449 | U | | 12/2014 | |
| CN | 106438355 | A | * | 2/2017 | ..... F04C 18/02 |
| CN | 106593865 | A | | 4/2017 | |
| CN | 109236643 | A | | 1/2019 | |
| CN | 208564965 | U | * | 3/2019 | ..... F04C 18/0215 |
| CN | 109882408 | A | | 6/2019 | |
| CN | 111022318 | A | * | 4/2020 | ..... F04C 18/0215 |
| WO | WO-2017195272 | A1 | * | 11/2017 | ..... F01C 1/0215 |

OTHER PUBLICATIONS

English translation of CN106438355 by PE2E May 12, 2023.*
English translation of CN101952550 by PE2E May 12, 2023.*
English translaiton of CN201318287 by PE2E May 12, 2023.*
English translation of CN208564965 by PE2E, Dec. 28, 2023.*
English translation of CN111022318 by PE2E, Dec. 28, 2023.*
International search report of PCT Patent Application No. PCT/CN2019/124711 dated Mar. 27, 2020.

* cited by examiner

DRY DUAL-SCROLL VACUUM PUMP

CROSS REFERENCE TO RELATED APPLICATIONS

The present application is a Continuation Application of PCT Application No. PCT/CN2019/124711 filed on Dec. 12, 2019, which claims the benefit of Chinese Patent Application No. 201910559359.5 filed on Jun. 26, 2019. All the above are hereby incorporated by reference in their entirety.

FIELD OF THE INVENTION

The present disclosure relates to the field of vacuum pumps, and in particular to a dry dual-scroll vacuum pump.

BACKGROUND OF THE INVENTION

A dry non-oil scroll vacuum pump is also referred to as a dry scroll pump, a scroll vacuum pump and a scroll pump, is a vacuum acquisition equipment which is clean and non-oil, has the advantages of few moving parts, good sealing performance, a compact overall structure, etc., and is widely applied to production and manufacturing in emerging industries such as a thin film, analytical test, semiconductor manufacturing and biological medicine. The production and manufacturing in the above-mentioned emerging industries make a new request and throw down a challenge with respect to structure design and optimization of a vacuum pump.

In order to adapt to production and manufacturing requirements of the above-mentioned new industries, the urgent problem to be solved for the development of a dry vacuum pump are how to optimize a design theory, improve the vacuumizing performance and improve the reliability of an overall machine. The current major aims of research on a dry non-oil scroll vacuum pump are how to improve the sealing performance, heat balance performance and a vacuumizing rate of the dry non-oil scroll vacuum pump on the premise of maintaining original advantages thereof.

SUMMARY OF THE INVENTION

The technical problem to be solved by the present disclosure are to provide a dry dual-scroll vacuum pump, and to improve the vacuumizing performance of a dry non-oil scroll vacuum pump and the sealing and heat resistance performance of an overall machine, where a design is highly integrated, efficient, energy-saving, simple and compact.

In order to solve the above-mentioned technical problems, the technical solution provided by the present disclosure is as follows: a dry dual-scroll vacuum pump, comprising a driving assembly and an upper cover located above the driving assembly. The driving assembly comprises an output shaft, and a movable disk is eccentrically arranged on the output shaft. Two groups of first scroll teeth that are centrally symmetrical are arranged on a side of the movable disk that faces the upper cover. A fixed disk is arranged at a lower end of the upper cover. Second scroll teeth that are in one-to-one correspondence with the first scroll teeth are arranged on the fixed disk, and the first scroll teeth are meshed with the second scroll teeth to form a compression cavity. The upper cover is further provided with an air inlet and an air outlet, which correspond to the compression cavity.

During a vacuumizing operation, air enters through the air inlet under the drive of the first scroll teeth and the second scroll teeth, and is discharged through the air outlet after passing through the compression cavity. The two groups of first scroll teeth and the two groups of the second scroll teeth that are in one-to-one correspondence form a dual-scroll structure, which increases an inhalation volume, and improves a vacuumizing rate, where a relative sliding speed of the scroll teeth can be reduced on the premise of the same vacuumizing rate. In addition, the scroll teeth that are symmetrically arranged enable a movable scroll disk to satisfy a static balance state, reduce a rotation inertia force and air pressure, and improve the stability of an operating vacuum pump.

Preferably, a tooth tip of each of the first scroll teeth and the second scroll teeth is provided with a sealing groove, and the sealing groove is internally provided with an elastic sealing material. The first scroll teeth and the fixed disk are sealed in a pressing manner, and the second scroll teeth and the movable disk are sealed in the pressing manner.

Preferably, the driving assembly comprises a housing, an upper end cover and a lower end cover. The output shaft penetrates the upper end cover and the lower end cover, and is respectively connected to the upper end cover and the lower end cover in a rotatable and movable manner. A sealing assembly is arranged the output shaft and each of the upper end cover and the lower end cover.

Preferably, several clump weights for balancing the movable disk are distributed on the output shaft, and a torque generated by the rotation of the movable disk that is arranged in a balanced and eccentric manner improves the stability of the overall vacuum pump.

Preferably, the pump further comprises at least one anti-rotation assembly arranged between the movable disk and the driving assembly or between the movable disk and the fixed disk.

Preferably, the anti-rotation assembly comprises a limiting shaft, with one end of the limiting shaft being fixedly connected to the movable disk. The driving assembly or the fixed disk is provided with a guide groove, which corresponds to a free end of the limiting shaft and is used for accommodating the free end of the limiting shaft and restraining the movement of the free end of the limiting shaft.

Preferably, the anti-rotation assembly comprises a limiting shaft, and two ends of the limiting shaft are each provided with a connection column that is eccentrically arranged, with one connection column being connected to the movable disk in the rotatable and movable manner, and the other connection column being connected to the driving assembly or the fixed disk in the rotatable and movable manner.

The anti-rotation assembly is used for restraining the movement of the movable disk relative to the fixed disk and the driving assembly, so as to ensure that the movable disk swings relative to the fixed disk, without rotating relative to the center.

Preferably, a first cooling cavity is provided in the fixed disk. A lower end of the driving assembly is connected to a bottom cover, and a second cooling cavity is provided in the bottom cover. The first cooling cavity and the second cooling cavity are in communication by means of a cooling channel and form a cooling circulation system. The cooling circulation system further comprises a liquid inlet and a liquid outlet.

Preferably, at least two groups of cooling channels are arranged between the first cooling cavity and the second cooling cavity, and the cooling channels are arranged to be tightly attached to the driving assembly and are uniformly distributed around the circumference of the driving assembly.

Preferably, the liquid inlet, the first cooling cavity, the cooling channels, the second cooling cavity and the liquid outlet are in communication in sequence.

A coolant liquid enters through the liquid inlet, enters the first cooling cavity through the cooling channel, then enters the second cooling cavity through another cooling channel, and is finally discharged through the liquid outlet, thereby forming water circulation, cooling the fixed disk and the driving assembly. The design of an inner circulation channel of cooling water effectively takes away heat, reduces the thermal deformation of the scroll teeth and improves the vacuumizing efficiency.

DETAILED DESCRIPTION OF THE EMBODIMENTS

In order to make the objectives, technical solutions and advantages of the present disclosure clearer, the present disclosure is further illustrated in detail below in conjunction with the accompanying drawings and embodiments. It should be understood that the particular embodiments described herein are merely illustrative of the present disclosure and are not intended to limit the present disclosure.

Embodiments

Figure 1:
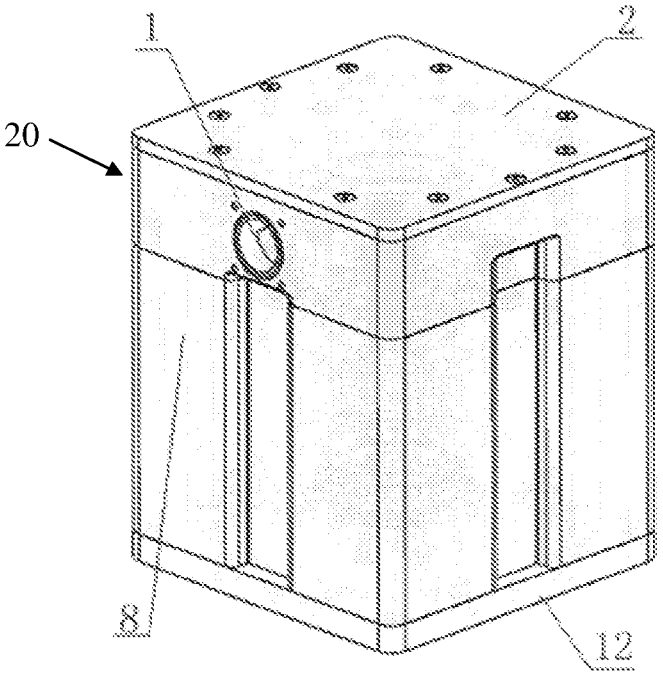
FIG. 1 is a perspective view of a dry dual-scroll vacuum pump of the present embodiment.
Figure 2:
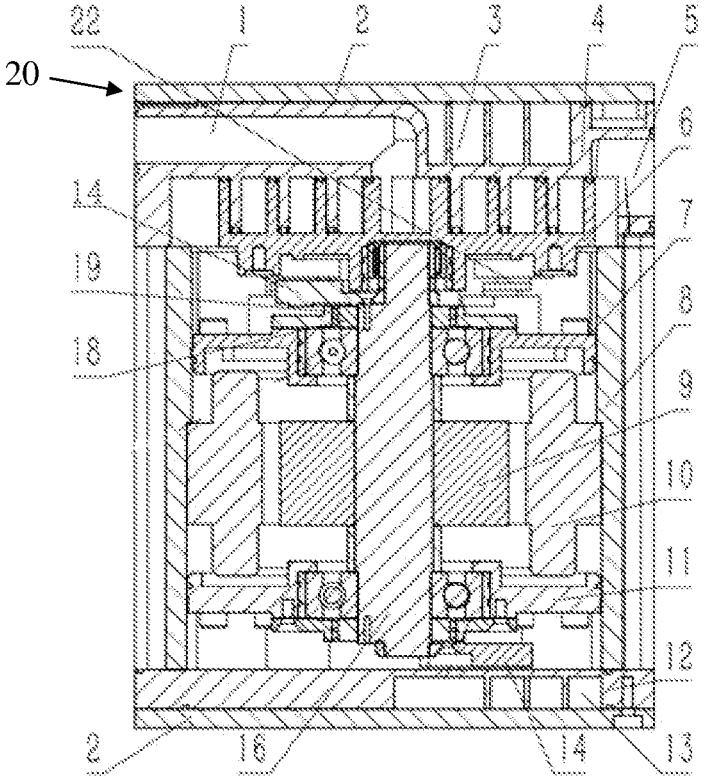
FIG. 2 is a full section view of the dry dual-scroll vacuum pump of the present embodiment.

As shown in FIG. 1 and FIG. 2, a dry dual-scroll vacuum pump comprises a driving assembly and an upper cover 20 located above the driving assembly, the upper cover 20 including a cover plate 2 and a fixed disk 4. The driving assembly comprises an output shaft 16, and a movable disk 6 is eccentrically arranged on the output shaft 16. Several clump weights 14 for balancing the movable disk 6 are distributed 16 on the output shaft 16, and a torque generated by the rotation of the movable disk 6 that is arranged in a balanced and eccentric manner improves the stability of the overall vacuum pump.

Figure 9:
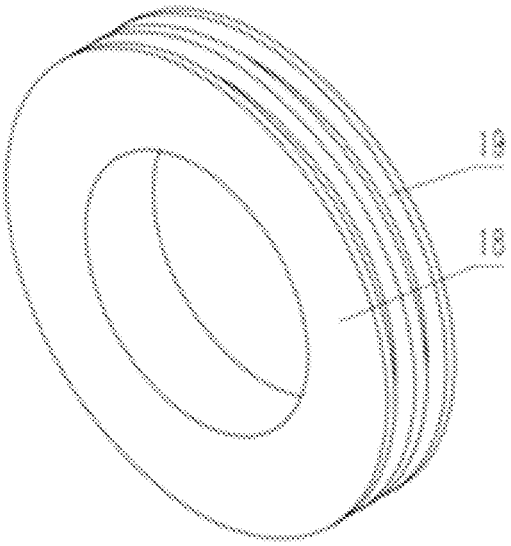
FIG. 9 is a perspective view of a shaft sealing member in the dry dual-scroll vacuum pump of the present embodiment.

As shown in FIG. 2, the driving assembly comprises a housing 8, an upper end cover 7 and a lower end cover 11, and a rotor 9 and a stator 10 of an electric motor are arranged in the housing 8. The output shaft 16 penetrates the upper end cover 7 and the lower end cover 11, and is respectively connected to the upper end cover 7 and the lower end cover 11 in a rotatable and movable manner. As shown in FIG. 2 and FIG. 9, a sealing assembly is arranged between the output shaft 16 and each of the upper end cover 7 and the lower end cover 11. The sealing assembly comprises a shaft sealing member 18 arranged between the output shaft 16 and the upper end cover 7, and several sealing strips 19 are distributed on an outer edge of the shaft sealing member 18.

Figure 3:
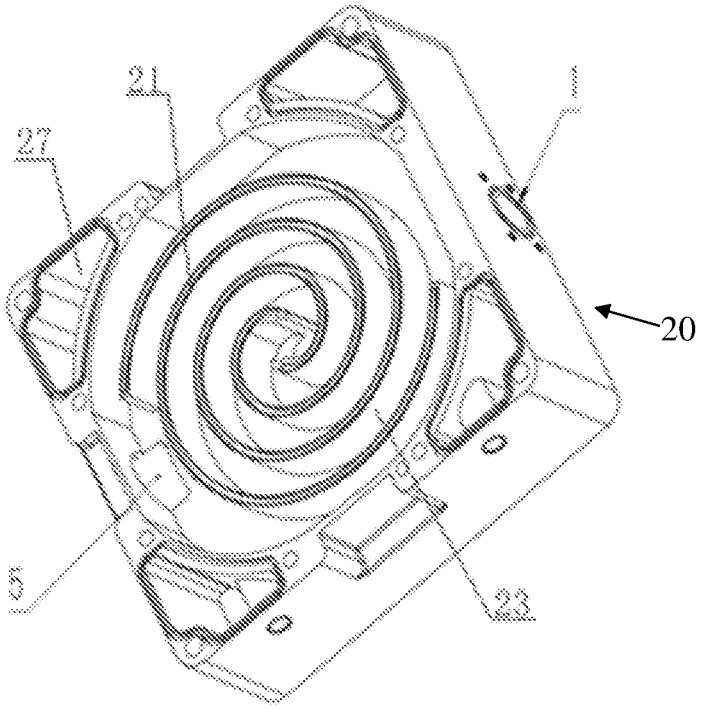
FIG. 3 is a perspective view of a fixed disk in the dry dual-scroll vacuum pump of the present embodiment.
Figure 5:
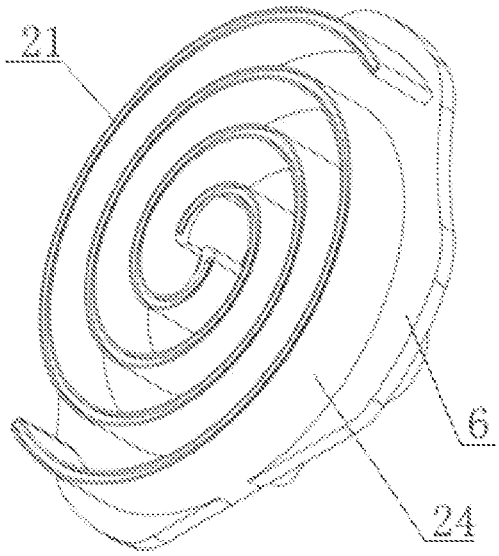
FIG. 5 is a perspective view of a movable disk in the dry dual-scroll vacuum pump of the present embodiment.

As shown in FIG. 3 and FIG. 5, two groups of first scroll teeth 24 that are centrally symmetrical are arranged on a side of the movable disk 6 that faces the upper cover 20. The fixed disk 4 is arranged at a lower end of the upper cover 20. Second scroll teeth 23 that are in one-to-one correspondence with the first scroll teeth 24 are arranged on the fixed disk 4. A tooth tip of each of the first scroll teeth 24 and the second scroll teeth 23 is provided with a sealing groove 21, and the sealing groove 21 is internally provided with an elastic sealing material. The first scroll teeth 24 and the fixed disk 4 are sealed in a pressing manner, and the second scroll teeth 23 and the movable disk 6 are sealed in the pressing manner. The first scroll teeth 24 are meshed with the second scroll teeth 23 to form a compression cavity. As shown in FIG. 1, FIG. 2 and FIG. 3, the upper cover 20 is further provided with an air inlet 5 and an air outlet 1, which correspond to the compression cavity.

During a vacuumizing operation, air enters through the air inlet 5 under the drive of the first scroll teeth 24 and the second scroll teeth 23, and is discharged through the air outlet 1 after passing through the compression cavity. The two groups of first scroll teeth 24 and the two groups of the second scroll teeth 23 that are in one-to-one correspondence form a dual-scroll structure, which increases an inhalation volume, and improves a vacuumizing rate, where a relative sliding speed of the scroll teeth can be reduced on the premise of the same vacuumizing rate. In addition, the scroll teeth that are symmetrically arranged enable a movable scroll disk to satisfy a static balance state, reduce a rotation inertia force and air pressure, and improve the stability of an operating vacuum pump.

Furthermore, as shown in FIG. 2, the pump further comprises at least one anti-rotation assembly 22 arranged between the movable disk 6 and the driving assembly or between the movable disk 6 and the fixed disk 4. The anti-rotation assembly 22 comprises a limiting shaft. The limiting shaft can be arranged in different manners, and is specifically used for restraining the movement of the movable disk 6 relative to the fixed disk 4 and the driving assembly, so as to ensure that the movable disk 6 swings relative to the fixed disk 4, without rotating relative to the center.

Figure 6:
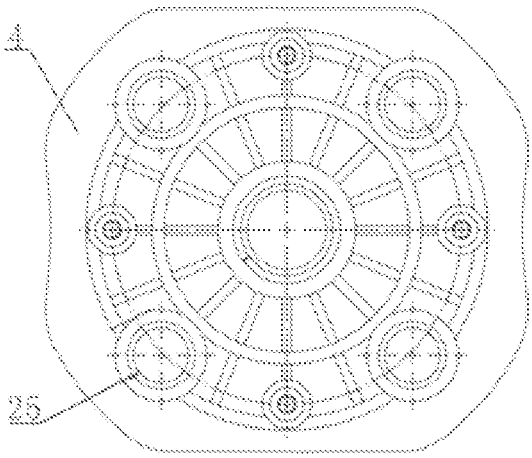
FIG. 6 is a bottom view of the movable disk in the dry dual-scroll vacuum pump of the present embodiment.
Figure 7:
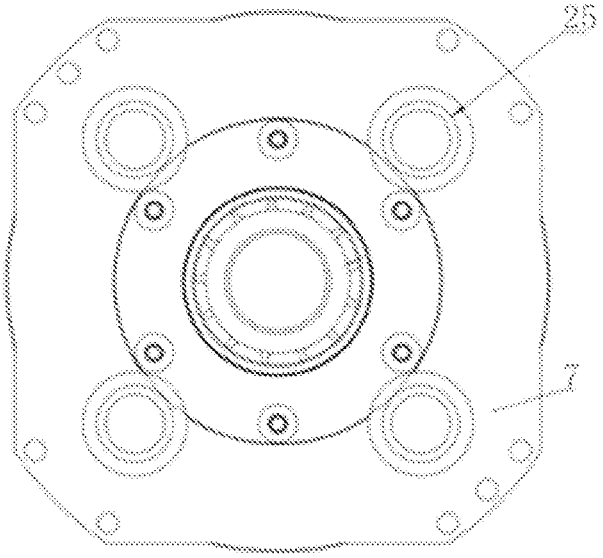
FIG. 7 is a schematic diagram of an upper end cover in the dry dual-scroll vacuum pump of the present embodiment.

The structure and working principle of the limiting shaft are specifically described below in two different manners (the specific structure of the limiting shaft is not shown in the accompanying drawings). 1. One end of the limiting shaft is fixedly connected to the movable disk 6. The driving assembly or the fixed disk 4 is provided with a guide groove, which corresponds to a free end of the limiting shaft and is used for accommodating the free end of the limiting shaft and restraining the movement of the free end of the limiting shaft. 2. The anti-rotation assembly 22 comprises the limiting shaft, and two ends of the limiting shaft are each provided with a connection column that is eccentrically arranged, with one connection column being connected to the movable disk 6 in the rotatable and movable manner, and the other connection column being connected to the driving assembly or the fixed disk 4 in the rotatable and movable manner. As shown in FIG. 6 and FIG. 7, the corresponding movable disk 6 is provided with connection holes 25 corresponding to mounting columns, and the driving assembly or the fixed disk 4 is also provided with connection holes 25 corresponding to the mounting columns.

Figure 4:
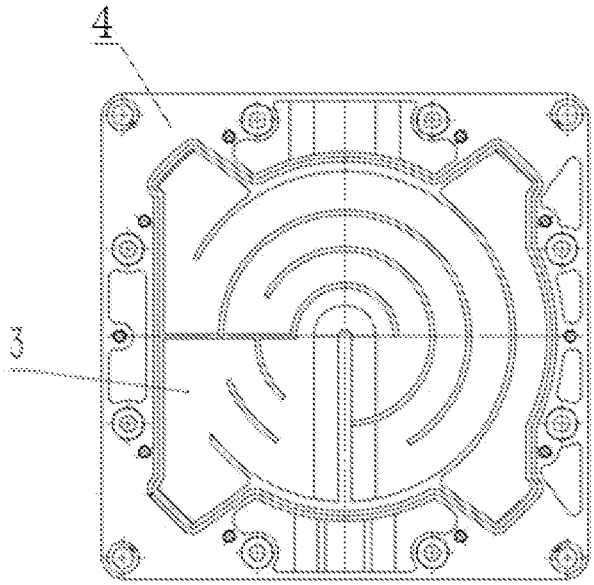
FIG. 4 is a schematic diagram of a first cooling cavity in the dry dual-scroll vacuum pump of the present embodiment.
Figure 8:
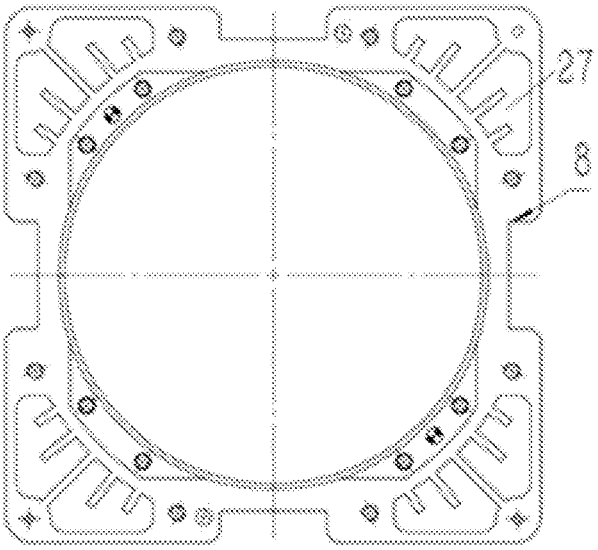
FIG. 8 is a top view of a housing in the dry dual-scroll vacuum pump of the present embodiment.
Figure 10:
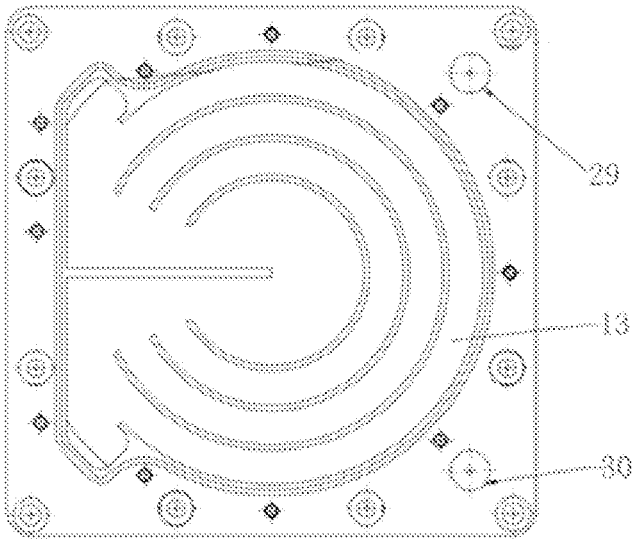
FIG. 10 is a schematic diagram of a bottom cover in the dry dual-scroll vacuum pump of the present embodiment.

Furthermore, as shown in FIG. 2, FIG. 3, and FIG. 4, a first cooling cavity 3 is provided in the fixed disk 4, and the cover plate 2 for sealing the first cooling cavity 3 is arranged on the fixed disk 4. As shown in FIG. 2 and FIG. 10, a lower end of the driving assembly is connected to a bottom cover 12. A second cooling cavity 13 is provided in the bottom cover 12, and the cover plate 2 for sealing the second cooling cavity 13 is arranged on the bottom cover 12. As shown in FIG. 2 and FIG. 8, the first cooling cavity 3 and the second cooling cavity 13 are in communication by means of a cooling channel 27 and form a cooling circulation system. The cooling circulation system further comprises a liquid inlet 29 and a liquid outlet 30. At least two groups of cooling channels 27 are arranged between the first cooling cavity 3 and the second cooling cavity 13, and the cooling channels 27 are arranged to be tightly attached to the driving assembly and are uniformly distributed around the circumference of the driving assembly. The liquid inlet 29, the first cooling cavity 3, the cooling channels 27, the second cooling cavity 13 and the liquid outlet 30 are in communication in sequence.

A coolant liquid enters through the liquid inlet 29, enters the first cooling cavity 3 through the cooling channel 27, then enters the second cooling cavity 13 through another cooling channel 27, and is finally discharged through the liquid outlet 30, thereby forming water circulation, cooling the fixed disk 4 and the driving assembly. The design of an inner circulation channel of cooling water effectively takes away heat, reduces the thermal deformation of the scroll teeth and improves the vacuumizing efficiency.

The dry dual-scroll vacuum pump described above improves the vacuumizing performance of a dry non-oil scroll vacuum pump and the sealing and heat resistance performance of an overall machine, where a design is highly integrated, efficient, energy-saving, simple and compact.

In summary, the above description is only preferred embodiments of the present disclosure, not intended to limit the present disclosure, any modifications, equivalent replacements, or improvements made within the spirit and principles of the present disclosure should be comprised within the scope of protection of the present disclosure.

The invention claimed is:

1. A dry dual-scroll vacuum pump, comprising a driving assembly and an upper cover located above the driving assembly, wherein the driving assembly comprises an output shaft (16), and a movable disk (6) eccentrically arranged on the output shaft (6); two groups of first scroll teeth (24) that are centrally symmetrical are arranged on a side of the movable disk (6) that faces the upper cover;

a fixed disk (4) is arranged at a lower end of the upper cover, second scroll teeth (23) that are in one-to-one correspondence with the first scroll teeth (24) are arranged on the fixed disk (4), and the first scroll teeth (24) are meshed with the second scroll teeth (23) to form a compression cavity; and the upper cover is further provided with an air inlet (5) and an air outlet (1), which correspond to the compression cavity;

wherein a first cooling cavity (3) is provided in the fixed disk (4), a lower end of the driving assembly is connected to a bottom cover (12), and a second cooling cavity (13) is provided in the bottom cover (12); the first cooling cavity (3) and the second cooling cavity (13) are in communication by means of a cooling channel (27) and form a cooling circulation system; and the cooling circulation system further comprises a liquid inlet (29) and a liquid outlet (30).

2. The dry dual-scroll vacuum pump according to claim 1, wherein a tooth tip of each of the first scroll teeth (24) and the second scroll teeth (23) is provided with a sealing groove (21), the sealing groove (21) is internally provided with an elastic sealing material, the first scroll teeth (24) and the fixed disk (4) are sealed in a pressing manner, and the second scroll teeth (23) and the movable disk (6) are sealed in the pressing manner.

3. The dry dual-scroll vacuum pump according to claim 1, wherein the driving assembly comprises a housing (8), an upper end cover (7) and a lower end cover (11), and the output shaft (16) penetrates the upper end cover (7) and the lower end cover (11), and is respectively connected to the upper end cover (7) and the lower end cover (11) in a rotatable and movable manner; and a sealing assembly is arranged between the output shaft (16) and each of the upper end cover (7) and the lower end cover (11).

4. The dry dual-scroll vacuum pump according to claim 1, wherein several clump weights (14) for balancing the movable disk (6) are distributed on the output shaft (16).

5. The dry dual-scroll vacuum pump according to claim 1, further comprising at least one anti-rotation assembly arranged between the movable disk (6) and the driving assembly or between the movable disk (6) and the fixed disk (4).

6. The dry dual-scroll vacuum pump according to claim 5, wherein the anti-rotation assembly (22) comprises a limiting shaft, with one end of the limiting shaft being fixedly connected to the movable disk (6); and the driving assembly or the fixed disk (4) is provided with a guide groove, which corresponds to a free end of the limiting shaft and is used for accommodating the free end of the limiting shaft and restraining the movement of the free end of the limiting shaft.

7. The dry dual-scroll vacuum pump according to claim 5, wherein the anti-rotation assembly (22) comprises a limiting shaft, and two ends of the limiting shaft are each provided with a connection column that is eccentrically arranged, with one connection column being connected to the movable disk (6) in the rotatable and movable manner, and the other connection column being connected to the driving assembly or the fixed disk (4) in the rotatable and movable manner.

8. The dry dual-scroll vacuum pump according to claim 1, wherein at least two groups of cooling channels (27) are arranged between the first cooling cavity (3) and the second cooling cavity (13), and the cooling channels (27) are arranged to be tightly attached to the driving assembly and are uniformly distributed around the circumference of the driving assembly.

9. The dry dual-scroll vacuum pump according to claim 1, wherein the liquid inlet (29), the first cooling cavity (3), the cooling channels (27), the second cooling cavity (13) and the liquid outlet (30) are in communication in sequence.

* * * * *